US006125516A

United States Patent [19]

Winkler

[11] Patent Number: 6,125,516

[45] **Date of Patent: *Oct. 3, 2000**

[54] METHOD OF PRODUCING AN ITEM OF HOLLOW JEWELRY

[75] Inventor: Wilhelm Winkler, Kolsassberg, Austria

[73] Assignee: D. Swarovski & Co., Wattens, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/113,228

[22] Filed: Jul. 13, 1998

[30] Foreign Application Priority Data

Jul. 18, 1997 [AT] Austria ..... 442/97 U

[51] Int. Cl.[7] ..... B23P 5/00

[52] U.S. Cl. ..... 29/10; 29/460; 29/896.412; 63/26; 63/27

[58] Field of Search ..... 63/1.16, 15, 26, 63/27, 34; 29/10, 896.412, 460; 205/72, 120

[56] References Cited

U.S. PATENT DOCUMENTS

| | | | |
|---|---|---|---|
| 332,183 | 12/1885 | Becker . | |
| 728,501 | 5/1903 | Sadler | 63/15 |
| 802,326 | 10/1905 | Sadler | 63/15 |
| 1,030,990 | 7/1912 | Farnham . | |
| 1,529,606 | 3/1925 | O'Donnell | 63/26 X |
| 1,654,335 | 12/1927 | Lindroth | 63/28 |
| 1,941,782 | 1/1934 | Bager | 63/27 |
| 2,537,449 | 1/1951 | Evenson | 63/15 |
| 2,835,117 | 5/1958 | Lutrario | 63/27 |
| 3,605,442 | 9/1971 | Parker et al. | 63/15 |
| 4,089,096 | 5/1978 | Michael | 29/160.6 |
| 4,154,282 | 5/1979 | Kull | 164/9 |
| 4,543,803 | 10/1985 | Keyasko | 63/2 |
| 4,581,088 | 4/1986 | House . | |
| 4,681,664 | 7/1987 | Eberle et al. | 204/9 |
| 4,710,276 | 12/1987 | Kull | 204/9 |
| 4,793,156 | 12/1988 | Pence | 63/26 |
| 4,819,453 | 4/1989 | McNamara | 63/28 |
| 4,972,685 | 11/1990 | Pöll | 63/26 |
| 5,044,177 | 9/1991 | Favre | 63/26 |
| 5,172,568 | 12/1992 | Senanayake | 63/2 |
| 5,218,839 | 6/1993 | Udko | 63/26 |
| 5,437,167 | 8/1995 | Ambar | 63/26 |

FOREIGN PATENT DOCUMENTS

| | | | |
|---|---|---|---|
| 0 346 698 | 12/1989 | European Pat. Off. . | |
| 0620987 | 10/1994 | European Pat. Off. . | |
| 0 707 804 | 4/1996 | European Pat. Off. . | |
| 2627512 | 8/1989 | France | C25D 3/48 |
| 3510200 | 9/1986 | Germany | 63/26 |
| 3818967 | 12/1989 | Germany . | |
| 3918920 | 12/1990 | Germany . | |
| 44 29 665 | 2/1996 | Germany . | |
| 06013619 | 8/1995 | Japan . | |
| 234281 | 11/1994 | Taiwan . | |
| 826492 | 1/1960 | United Kingdom | 63/26 |

OTHER PUBLICATIONS

"Design of Golden Ornament and Method of Inlay"by Gung Yang Lai, Fuhan Publishing Co., Ltd. published Nov. 1998 pp. 190–193 and (pp. 1–4 English translation).

*Primary Examiner*—David P. Bryant
*Assistant Examiner*—Essama Omgba
*Attorney, Agent, or Firm*—Wenderoth, Lind & Ponack, L.L.P.

[57] ABSTRACT

An item of hollow jewelry having at least one precious stone which is fitted into the galvanically produced wall thereof and which is held fast by galvanically applied material, wherein a setting (2) of metal sheet which surrounds the precious stone (1) is arranged between the precious stone (1) and the wall (4).

6 Claims, 3 Drawing Sheets

METHOD OF PRODUCING AN ITEM OF HOLLOW JEWELRY

BACKGROUND OF THE INVENTION

The present invention relates to an item of hollow jewelry comprising at least one precious stone which is fitted into the galvanically produced wall thereof and which is held fast by galvanically applied metal.

Currently, hollow jewelry is frequently produced not by pressing but by a galvanic procedure in which an original model or design of steel is cast in silicone and that silicone mold is used to produce a large number of wax models which correspond to the original model. The wax models are coated with a conductive silver lacquer and so much gold is galvanoplastically applied to the conductive surface that the coating of the wax model becomes self-supporting. Finally, the wax can be melted out of the hollow body. Instead of wax it is also possible to use white metal (tin-bismuth).

Precious stones are electrically non-conductive. Embedding them in hollow jewelry produced by a galvanic procedure is therefore relatively complicated. In accordance with the disclosure of reference DE 35 44 429 C2, the wall of the hollow jewelry is of such a configuration that, after termination of the galvanization operation, stones can be fitted into prepared openings in the wall. So that the stones can be retained therein, outward bulge portions of the wall surface are subsequently mechanically shaped. On the other hand, reference EP 0 620 987 disclosed a process which involves firstly producing an item of hollow jewelry with a closed wall. The stones are fitted into depressions in the wall, in which case the largest diameter of the stones is approximately at the upper edge of the depression. Continued galvanic application of metal results in the formation of an edge bead or ridge which slightly engages over the stone and which is intended to hold the stone fast.

The known processes suffer from the disadvantage that the operation of inserting the stone is effected only in the course of the galvanization procedure, whereby damage to the extremely thin wall (about 0.2 mm) of the item of hollow jewelry can occur. In addition, the holding region which provides for fixing the stone to the item of hollow jewelry is poorly defined.

SUMMARY OF THE INVENTION

The object of the present invention is thus to provide an item of hollow jewelry in which good fixing of the inserted precious stones is ensured in a simple manner.

According to the present invention, the aforementioned object is achieved by the use of setting of metal sheet, which surrounds the precious stone and is arranged between the precious stone and the wall.

The setting or holder member which provides for the connection between the precious stone and the hollow wall can, in principle, be designed in a known manner (U.S. Pat. No. 4,972,685, FIG. 10). However, while projections provided on the setting usually engage in frictional locking engagement into the wall of bores in the jewelry, in the case of hollow jewelry there is the possibility of engaging behind the wall of the item of jewelry. It is also desirable for the setting to be of such a configuration that it can be easily fitted into the wax model which serves to produce the hollow jewelry.

BRIEF DESCRIPTION OF THE DRAWINGS

Details of the invention are described hereinafter with reference to the drawings in which.

DETAILED DESCRIPTION OF THE INVENTION

Figure 1:
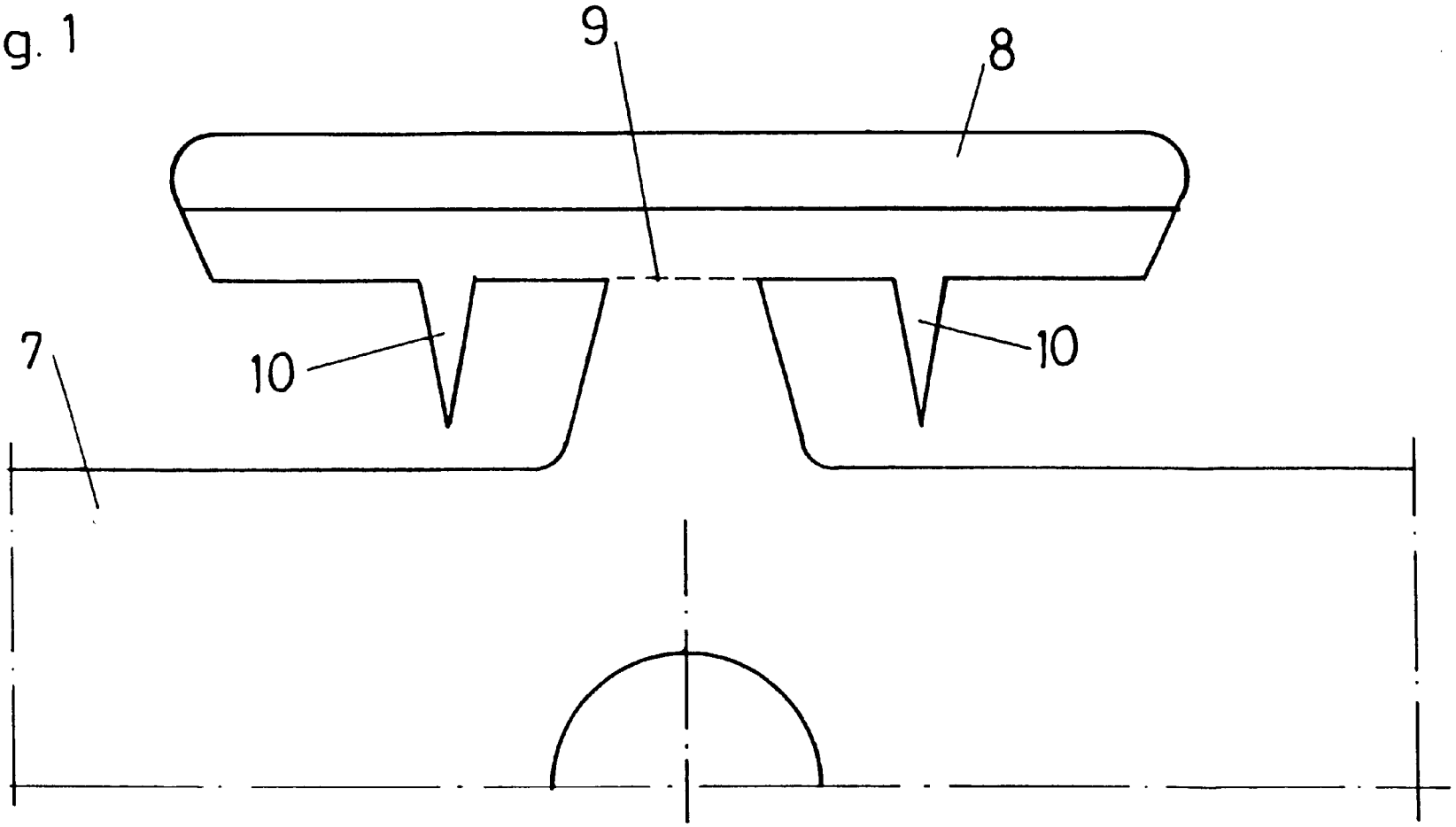
FIG. 1 illustrates the metal sheet blank from which a setting according to the invention for a precious stone can be formed.
Figure 2:
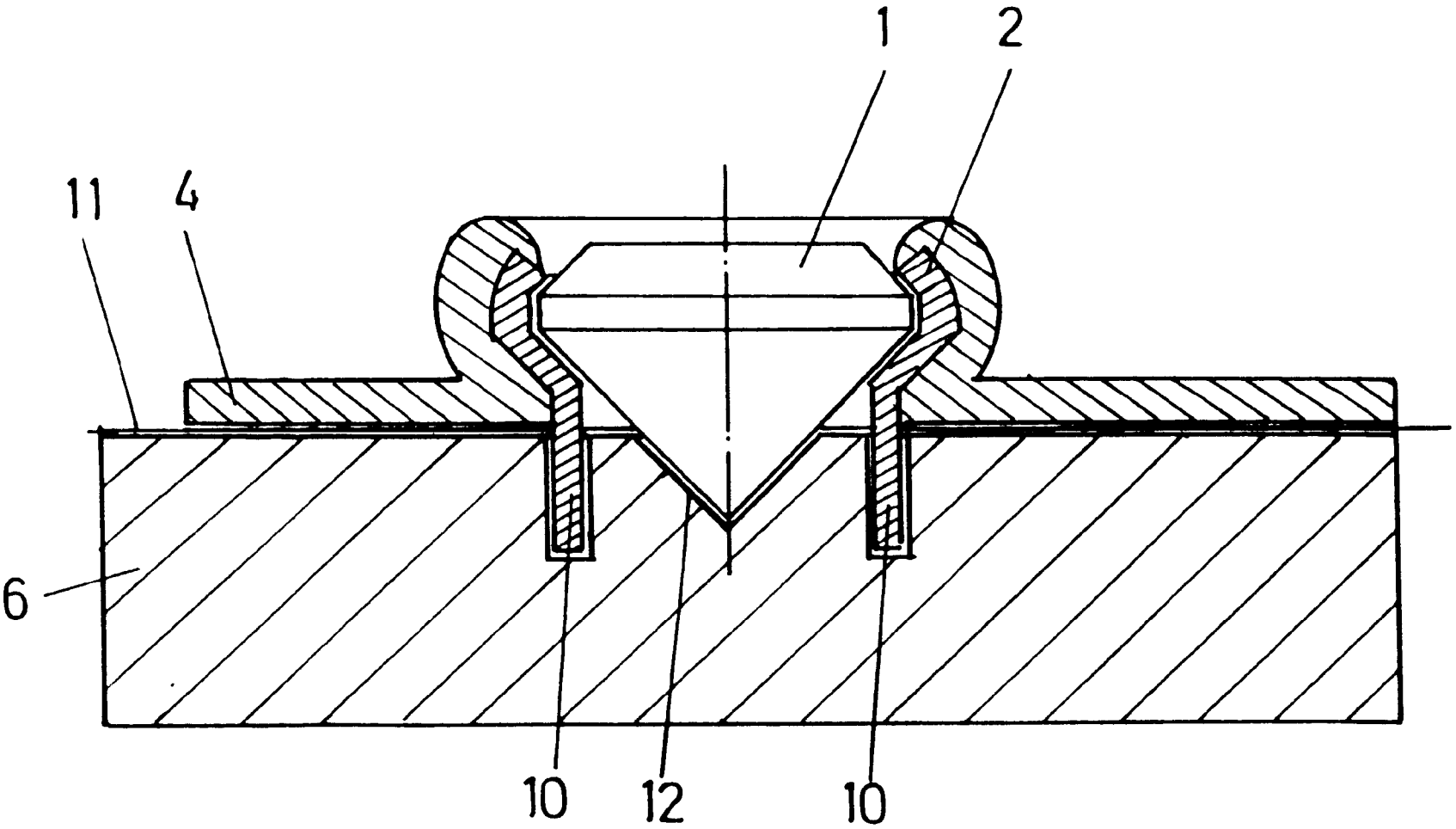
FIG. 2 illustrates the cross-section and the procedure involved when embedding a stone in the production of hollow jewelry.

In accordance with the present invention, in order to be able to fit precious stones into hollow jewelry, the precious stones are surrounded with a setting of metal sheet. The setting usually comprises the same precious metal as the hollow jewelry. The setting is produced by sheet blanks 8 being severed from the carrier strip 7, illustrated in FIG. 1, along the broken line 9. The blanks 8 are laid around the stone along the greatest periphery. The way in which the setting 2 produced from the blank 8 surrounds a precious stone 1 along its greatest periphery will be apparent from FIG. 2.

Figure 3:
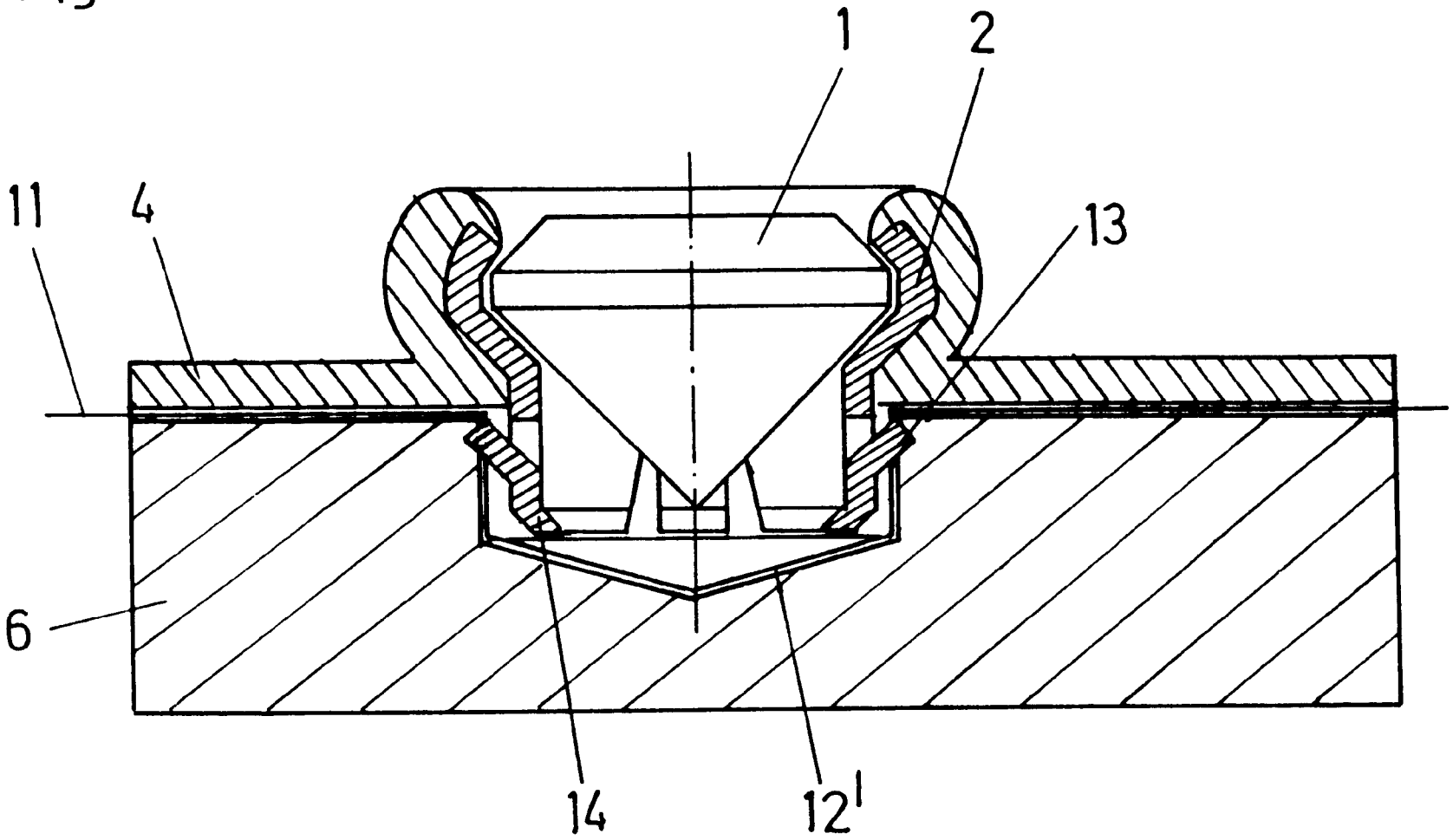
FIG. 3 corresponds to FIG. 2 for a modified setting.

In the production of hollow jewelry, firstly, a wax model 6 is produced of the desired shape. It has bores 12 for the subsequent insertion of stones. The wax model 6 is coated with a layer 11 of electrically conductive silver lacquer and then the setting 2 for holding the stone 1 is pressed with the tips 10 into the wax model 6. A layer, in particular of gold, which forms the wall 4 of the item of hollow jewelry, is then applied in a galvanization bath; the layer is typically of a thickness of the order of magnitude of 0.2 mm. The galvanic layer forming the wall 4 engages over the setting 2 and forms a unit therewith whereby the stone 1 is anchored securely and in a defined fashion in the item of hollow jewelry which is finally afforded by removal of the wax model 6, In the embodiment shown in FIG. 3, the setting 2 of the precious stone 1 is inserted into a bore 12' whose diameter corresponds to the cylindrical lower edge of the setting 2. The insertion operation is facilitated by the conical edge 14 of the setting 2. Here resilient projections 13 on the setting 2 are first pressed into the wax model 6 and, in the finished condition of the item of hollow jewelry, they are engaged behind the wall 4.

In the illustrated embodiments, the precious stone 1 is in the form of a chaton. The present invention, however, is not limited thereto and, for example, could also be used in relation to so-called squares. The size of the inserted precious stone is limited downwardly by the possibility of producing a suitable setting 2. Stones of more than 4 mm in diameter are, on the other hand, not demanded by the market.

What is claimed is:

1. A method of producing an item of hollow jewelry, said method comprising:

1) providing a model of a predetermined shape having at least one bore formed in the model for placing a portion of a stone therein;

2) coating the model with an electrically conductive material;

3) providing a metallic setting to surround and hold the stone and pressing the metallic setting into the model such that the portion of the stone is placed into the bore of the model;

4) galvanically applying a layer of predetermined material onto the electrically conductive material and the metallic setting to thereby form a galvanically produced wall which engages over the metallic setting to thereby securely anchor the stone; and 5) removing the model.

2. The method as claimed in claim 1, wherein the metallic setting is provided with projections (13), and said method further comprising engaging the projections behind the galvanically produced wall.

3. The method as claimed in claim 1, wherein the metallic setting is provided with tips (10), and said pressing the metallic setting into the model comprises inserting the tips into the model.

4. The method as claimed in claim 1, wherein the model is made from wax.

5. The method as claimed in claim 1, wherein the model is made from white metal (tin-bismuth).

6. The method as claimed in claim 1, wherein the electrically conductive material is silver lacquer.

* * * * *